US005082101A

United States Patent [19]

Baker et al.

[11] Patent Number: 5,082,101

[45] Date of Patent: Jan. 21, 1992

[54] COIN OPERATED VENDING MACHINE

[76] Inventors: David W. Baker, 8772 Tavernor Rd., Wilton, Calif. 95693; Joe K. Caradine, 9167 Falcon Ridge Ln., Fair Oaks, Calif. 95628

[21] Appl. No.: 356,187

[22] Filed: May 24, 1989

[51] Int. Cl.[5] ..... G07F 13/02

[52] U.S. Cl. ..... 194/350; 222/238; 222/306; 222/349

[58] Field of Search ..... 194/255, 292, 335, 350; 222/144, 238, 306, 348, 349, 350; 221/119, 120, 132, 200, 266

[56] References Cited

U.S. PATENT DOCUMENTS

| | | | |
|---|---|---|---|
| D. 90,652 | 9/1933 | Gilmer . | |
| D. 95,207 | 4/1935 | Hoban . | |
| D. 112,942 | 1/1939 | Garner . | |
| D. 180,619 | 7/1957 | Probasco . | |
| 1,387,681 | 8/1921 | Bertram | 194/335 |
| 1,842,243 | 1/1932 | Boyer | 194/255 X |
| 2,010,877 | 8/1935 | Morell . | |
| 2,259,710 | 10/1941 | Stern | 222/306 X |
| 2,465,146 | 3/1949 | Broussard . | |
| 2,483,805 | 10/1949 | Broussard et al. . | |
| 2,537,317 | 1/1951 | Probasco | 194/292 X |
| 2,633,272 | 3/1953 | Moore et al. | 222/238 |
| 2,828,909 | 4/1958 | Sollenberger et al. . | |
| 2,990,975 | 7/1961 | Sereno | 222/349 X |
| 3,171,591 | 3/1965 | Long . | |
| 3,807,628 | 4/1974 | Bock . | |
| 4,037,700 | 7/1977 | Heraty | 194/350 |
| 4,363,392 | 12/1982 | McDonald | 194/350 |
| 4,679,684 | 7/1987 | Glaser | 194/350 |
| 4,896,798 | 1/1990 | Milton | 194/255 X |

*Primary Examiner*—F. J. Bartuska
*Attorney, Agent, or Firm*—Bernhard Kreten

[57] ABSTRACT

A vending machine operated by a coin which allows a vendee one of several choices, by providing a plurality of modules each containing a different item to be vended in a single housing. The housing is supported on a turntable which allows the vendee to rotate the vending machine to address the appropriate item to be purchased. The device includes a coin return for returning coins of inappropriate size, and eliminates the necessity of having to invert the machine during the several instances required to replace goods, for hygienic purposes. In addition, structure associated with the instant invention allows greater likelihood that each vendee will receive the intended allotment by providing an agitation paddle just above the gate which dispenses the items to be purchased. A coin safe renders less likely the incidence of pilferage.

11 Claims, 4 Drawing Sheets

COIN OPERATED VENDING MACHINE

FIELD OF THE INVENTION

The following invention relates generally to vending machines of the type once referred to as "penny gumball machines," which dispense candy, nuts, gum, and small novelty items.

BACKGROUND OF THE INVENTION

One of the most common vending machines includes a transparent bubble dome within which food, candy, gum or toys dimensioned substantially as pellets can be displayed. The transparent dome is supported on a cast housing which includes a crank handle. A slot receives a coin to allow rotation of the crank handle and discharge a certain quantum of the pellets down a discharge chute to a vendee. The housing is normally supported on a pedestal having a base which is thereafter secured in some manner to prevent the unauthorized asportation of the machine from the premises.

Some evolution in this type of machine has occurred. For example, it is now fairly common to see a triad of such machines supported on a single pedestal, with the triad of machines being oriented in series. Several inefficiencies exist with respect to both of these designs.

One form of inefficiency involves the construction of the transparent dome which displays the pellets to the vendee. Typically, the transparent dome has an open bottom. Thus, to gain access to the interior of a vending machine which is not empty the machine must be inverted to keep from spilling the contents within the transparent dome. As a result, such a machine's interior will typically not be accessed for cleaning until very little of the contents remain, since inverting the machine causes several further associated inefficiencies.

A further inefficiency involves the retrieval of coins from some older machines. Most coins are fed into a slot on an outer front face of the vending machine. The slot is formed within a disc operatively connected to a crank handle which is capable of rotation only in the presence of an appropriately dimensioned coin, since only the appropriate coin trips a latch mechanism. Once the crank handle has been rotated, the coin exits from the slot at a lower most position of the disc, and rolls down a chase into a coinbox which is open topped. Thus, if the machine is to be accessed by inverting the transparent dome before its contents have been exhausted, the money within the coin box will become displaced because the vending machine must be inverted to keep the contents within the dome from spilling out. Most newer machines have a locked access door to the coinbox to solve this problem.

A further form of inefficiency involves the utilization of the wrong denomination coin, an inappropriate token or slug. First, it should be noted that most machines will not admit a coin having a diameter greater than the coin necessary to make the machine work. Thus, a quarter machine will not have a slot sufficiently large to receive a half-dollar. However, when a smaller dimensioned coin, such as a penny, nickel or dime is inserted within the quarter slot, most prior art machines will jam and become inoperative until one can pull the wrong coin from the slot. If the potential vendee is incapable of removing the wrong denominated coin, the machine must sit idle until the vendor attends the machine for regular servicing or maintenance. Since the contents within the dome have not been exhausted because the machine has been disabled, this service call for replenishment is inefficient. Second, to remove a wrong sized coin, it is sometimes necessary to invert the machine which dislodges the coins already within the coin box.

Some more modern vending machines will incorporate a slit that communicates with the slot and allows a smaller dimensioned coin to pass directly from the slot into the coinbox thereby unjamming the machine, but depriving the vendee from the potential to retrieve the coin. This sometimes engenders animosity on the part of the vendee.

A further source of irritation to a vendee may include the purchase of nonuniform amounts of goods from the machine itself. Typically, the pellets within the dome communicate with a gate type device at a lower most portion which ideally administers a uniform quantum of the articles to the vendee. Typically such a gate is formed as an enclosure having an opening in communication with the contents in the dome. Rotation of the handle, as permitted by the coin, allows the enclosure to rotate thereby inverting the enclosure opening and allowing the contents within the enclosure to be discharged down a chute for access by the vendee upon the pivotal manipulation of a flap which controls access to the chute. One problem frequently entails the vexing problem of "bridging" of the pellet shaped contents residing within the dome. Curiously, when a vendee buys some of the contents in the dome, and a quantum of pellets have been discharged through the gate, pellets not discharged and immediately above the gate sometimes will form an archway thereby defining a void under the archway and providing an obstruction precluding the throughpassage of further pellets within the gate. Successive vendees who receive disproportionate amounts of the pellets can sometimes become irate and, in an attempt to overcome the arch effect, impart vibration to the machine which passersby may interpret as machine abuse.

A further form of inefficiency entails the use of unsecured open topped coinboxes. Since it is sometimes desirable to delegate duties, one may hire a third party to replenish the machines and extract the coins. Because the contents of the container is accessible by the third party, some vendors may fear that the third party is under-reporting the income from a given machine. Because of the nature of this business, a vendor will not necessarily be able to detect under-reporting of income even if that under-reporting is substantial.

The following patents reflect the state of the art of which applicant is aware insofar as these patents appear relevant to the instant process. It is stipulated that none of these patents either singularly or in any conceivable combination teach or render obvious that which is the claimed nexus of the instant invention:

| | |
|---|---|
| D179518 | Probasco |
| D95207 | Hoban |
| D90652 | Gilmer |
| D112942 | Garner |
| 2 010 877 | Morell |
| 3 171 591 | Long |
| 2 613 871 | Broussard |
| 3 807 628 | Beck |
| 2 828 909 | Sollenberger |

SUMMARY OF THE INVENTION

The instant invention is distinguished over the known prior art in a plurality of ways. One key feature involves the hygienic aspects of the instant invention. The transparent "dome" according to the instant invention is modular and includes a bottom wall within which the gate is attached. This mean that the interior of the vending machine can be accessed without inverting the machine. These modules can be taken to a remote site for subsequent cleaning while the vending machine stays in place with new, clean modules. Thus, the machine interior can be conveniently accessed at all times without having to invert the machine or disrupt the contents within the dome.

A further attribute inherent with the instant invention allows a plurality of modules to be oriented on a single housing. Each module is accessible by providing a rotatable swivel between the housing and a support pedestal. This allows a plurality of different types of material, such as food, gum, toys, etc., to be displayed in a single machine, thereby simultaneously allowing a greater variety to the vendee, enhancing the aesthetic appeal of the display and saving on display space.

A further distinguishing feature which the instant invention enjoys over the known prior art entails the use of a paddle which lies immediately above the opening associated with the gate. This paddle rotates in unison with both the gate as it inverts to discharge the contents into the chute and the coin operated handle. Thus, any "arching" tendency by having the candy or other pellets bridge above the opening will be offset with the instant invention because the paddle disrupts any tendency the pellets may have to form an arch above the gate. This leads to an increased likelihood that a potential vendee will not be frustrated from having received a lesser amount of the contents from the machine than intended.

A further distinguishing characteristic of the instant invention entails the use of a slit associated with the coin slot which returns a wrong dimensioned coin back to the vendee. Since it is foreseeable that a potential vendee may be a child who does not have full command of the distinction between different denomination coins, ill will can be engendered by not returning a wrong sized coin to the vendee. With the structure according to the instant invention, a return slit gives the potential vendee the wrong sized coin back.

A further distinguishing characteristic of the instant invention entails the use of a coin canister which receives the coins from the vending machine in such a manner that the third party who retrieves the coins and replenishes the contents within the vending machine does not have direct access to the coins themselves, but merely the canister within which the coins reside. The coin canister is strategically configured to reduce the likelihood that coins can be extracted therefrom, and allows the third party to service the machine more expeditiously then heretofore. In addition, a certain degree of security is imparted to the third party since that canister is not accessible by him, thereby making him a less likely target from potential robbers.

OBJECTS OF THE INVENTION

Accordingly, it is a primary object of the present invention to provide a novel and useful device for dispensing pellet shaped articles from a vending machine.

A further object of the present invention is to provide a device as characterized above which provides an attractive display, is durable in construction, reliable in use and overcomes known prior art deficiencies.

A further object of the present invention contemplates providing a device as characterized above which enhances the hygienic aspects of comestibles in such a vending machine, increases the likelihood that the vendee receives the contemplated allotment, and has provisions for the return of wrong denomination coins to the vendee.

A further object of the present invention contemplates providing a device as characterized above which minimizes the opportunity for embezzlement by a third party employee.

A further object of the present invention contemplates providing a device as characterized above in which a plurality of different types of vendable articles is contained within modules supported on a housing which rotates to provide a more attractive display and allow access to the several types of articles by a single vendee with a minimum amount of display space.

A further object of the present invention contemplates providing a device as characterized above in which the articles to be vended are contained within modular units having a closed bottom wall which allows the modules to be replaced without having to invert the machine.

Viewed from a first vantage point, it is an object of the present invention to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, wherein the improvement comprises:

agitation means contained within the reservoir and coupled to the coin operated mechanism whereby a coin also enables the agitation means.

Viewed from a second vantage point it is an object of the present invention to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, and a coin storage area which receives coins from the operating mechanism, wherein the improvement comprises:

the coin storage area configured as a sealed canister having a coin inlet dimensioned to just receive the coin and a locked portal giving access to an interior of said canister whereby pilferage of the coins is less likely.

Viewed from a third perspective it is an object of the present invention to provide a coin storage area which receives coins from the operating mechanism, wherein the improvement comprises:

the coin storage area configured as a sealed canister having a coin inlet dimensioned to just receive the coin and a locked access portal to an interior of said canister whereby pilferage of the coins is less likely wherein said coin inlet includes a peripheral flange, a shelf extending radially inward from said flange, a pair of diametrically opposed arcuate and conically tapering segments extending from said shelf towards said coin inlet, a pair of diametrically opposed ramps interrupting said segments and extending from said shelf and towards said coin inlet, and a converging nozzle tapering from said ramps and segments to said coin inlet.

Viewed from a fourth vantage point, it is an object to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, and a coin storage area which receives coins from the operating mechanism, wherein the improvement comprises:

a coin chase extending from the coin operating mechanism to the coin storage area, said coin chase integrally formed with said chute.

Viewed from a fifth vantage point, it is an object to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, wherein the improvement comprises:

said reservoir formed as a module configured as an open top container and removable from connection with the coin operated mechanism where the mechanism couples with said gate, whereby said reservoir can be replaced along with the gate without emptying its contents.

Viewed from a sixth vantage point, another object is to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, wherein the improvement comprises:

an antijam mechanism integrally formed in the coin operated mechanism calculated to discharge a coin of wrong dimension back to a vendee, configured as a slot for receiving the coin and a slit of lesser dimension than said slot addressing said slot and exposing a passageway away from said slot and to an exterior of said coin operating mechanism, said slit and passageway discharging the wrong coin by declination from said slot relying on gravity.

Viewed from a seventh vantage point, an object is to provide a vending machine of the type having a reservoir containing articles to be vended, a coin operated mechanism, an article discharge chute, a measuring gate interposed between the chute and the reservoir to control the volume of articles released from the reservoir to the chute, the gate coupled to the coin operated mechanism such that the gate is enabled by a coin, wherein the improvement comprises:

said reservoir formed as a module configured as an open top container and removable from connection with the coin operated mechanism where the mechanism couples with said gate, whereby said reservoir can be replaced without emptying its contents, and wherein said plural said reservoirs are provided with plural, matching coin operating mechanisms, chutes and gates, all contained within a housing, and rotation means connecting said housing to an underlying support to allow a specific reservoir to be addressed through housing rotation by a vendee.

A further object is to provide a gate which hygienically allows the gate's volume to be modified.

An additional object is to offset the likelihood that the gate mechanism will jam or crush a pellet being vended.

These and other objects will be made manifest when considering the following detailed specification when taken into conjunction with the appended drawing figures.

DESCRIPTION OF THE DRAWING FIGURES

BRIEF DESCRIPTION OF THE PREFERRED EMBODIMENT

Figure 1:
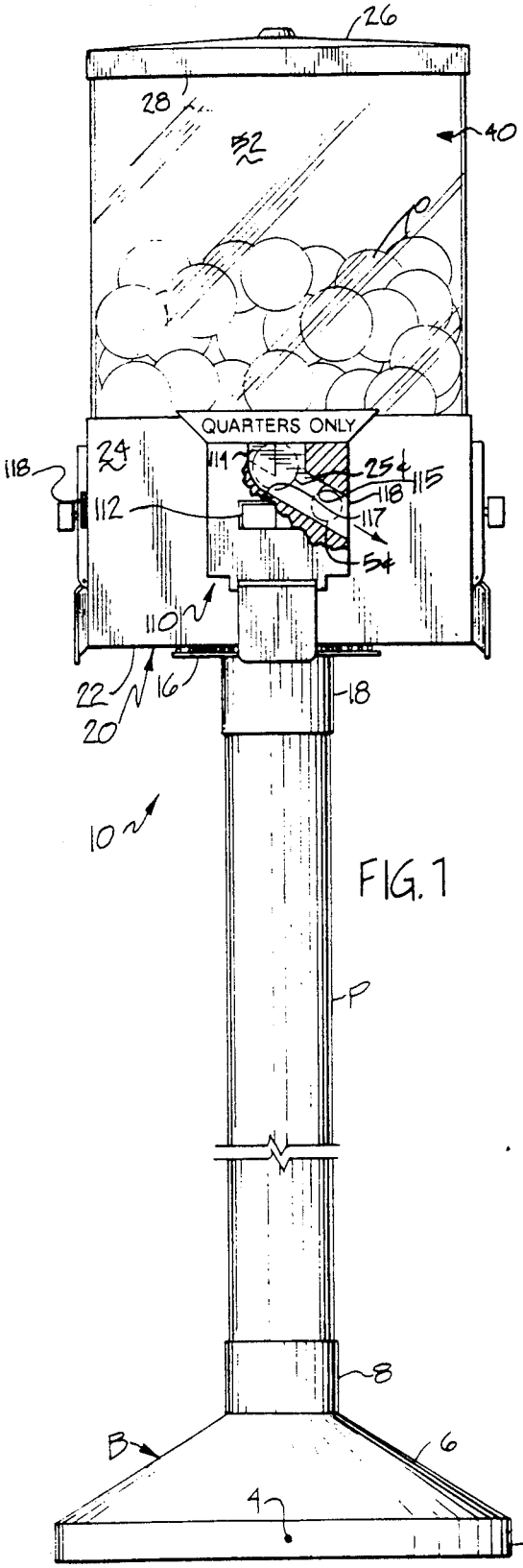
FIG. 1 is a front view of the vending machine according to the instant invention.

Referring to the drawings now, wherein like reference numerals refer to like parts throughout the various drawing Figures, reference numeral 10 is directed to the vending machine according to the instant invention.

In its essence, the vending machine 10 includes a base B which supports a pedestal P. The pedestal, in turn, supports a housing 20 in an elevated horizontal plane. The housing is capable of rotation about the vertical axis defined by the pedestal P thereby exposing one of a plurality of modules 40 to a "front" portion of the machine and addressed by a vendee. Each of the plural modules includes a different variety article, affording the vendee plural choices. When a specific module is to be accessed, an associated coin mechanism 110 coupled to the specific module allows the vendee to buy a portion of the contents from the module with a coin.

More specifically, the vending machine 10 includes a base B having a vertically disposed peripheral lip 2 provided with an opening 4 to allow the peripheral lip and therefore the vending machine 10 to be connected to a secure area, such as an anchor extending from concrete. This reduces the likelihood that the vending machine 10 will be transported away by an unauthorized person. The anchor is not shown in the drawings. The base B also includes a top wall 6 which tapers upwardly and inwardly in a conical fashion and is truncated adjacent its attachment to the pedestal P. Thus, the pedestal P rests upon a horizontal planar surface 7 as the area of truncation.

Figure 3:
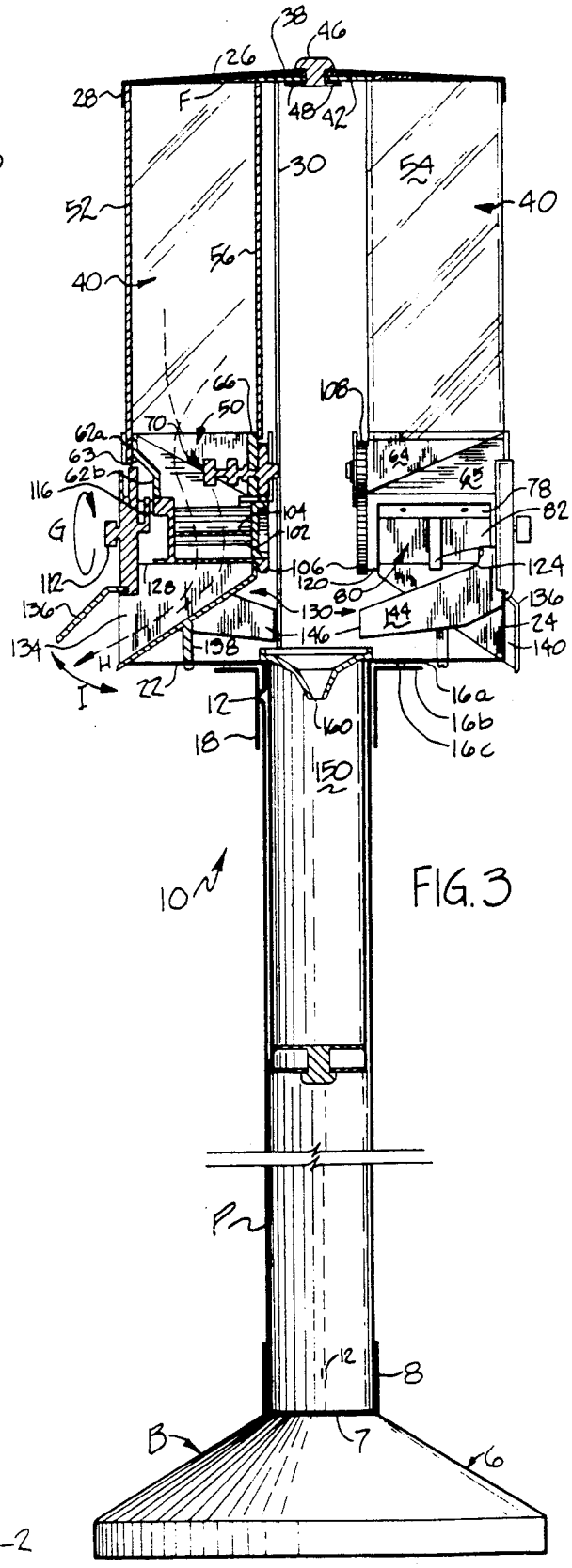
FIG. 3 is a sectional view taken along lines 3—3 of FIG. 2.

The pedestal P is preferably of elongate cylindrical configuration having a lower portion which slides within a sleeve 8 extending upwardly from the base B. The sleeve 8 retains the lower portion of the pedestal P by means of a plurality outwardly extending protuberances 12 formed from distressing the outer wall of the pedestal P. These protuberances frictionally engage the inner wall of the sleeve 8 as shown in FIG. 3.

The pedestal P also has protuberances 12 extending outwardly from an upper portion thereof which frictionally engages a sleeve 18 depending from a lower portion of a housing 20. As shown in FIGS. 1 and 3, the housing 20 has a bottom wall 22 which connects with the sleeve 18 via a turntable 16. Thus, the housing 20 is capable of rotating in the direction of the double ended arrow A of FIG. 2 about a vertical axis defined by a central axis of symmetry of the pedestal P. As shown, the turntable 16 is formed from an upper 16*a* and lower 16*b* race having a plurality of ball bearings 16*c* interposed therebetween to provide a relatively low friction area of rotation. Note that the bottom wall 22, the upper race plate and lower race plate all have a central opening which allow communication between the interior of the housing 20 and the interior of the pedestal P for purposes to be discussed shortly.

The housing 20 has a plurality of upwardly extending sidewalls 24, to define a housing having a polygonal shape. In a preferred form of the invention, four sidewalls 24 are provided and each sidewall supports a coin mechanism 110 centrally thereof for reception of coins by a vendee and an associated discharge chute 130 for reception of goods purchased by the vendee in a manner to be defined.

As thus far described, the housing 20 defines a substantially open topped container. However, the housing includes a lid 26 spaced from a top edge of the sidewalls 24, but forms a sealed vending machine 10 when taken in conjunction with reservoir modules 40 to be described. As shown in FIGS. 1 and 3, the lid 26 includes a downwardly extending peripheral lip 28 facing towards the sidewalls 24 and overlapping an upper side portion of the modules 40. Preferably, the inner surface of the lid 26 abuts against the modules 40 through foam F to provide shock absorption and a cushion.

Figure 6:
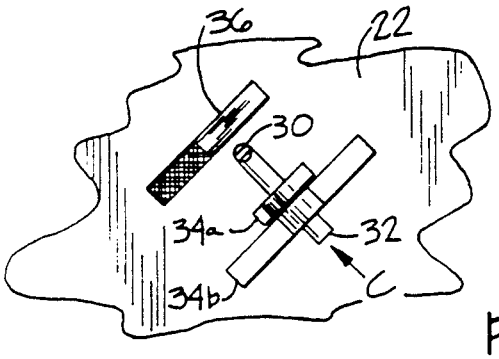
FIG. 6 is a detail of a wire retention mechanism highlighted in FIG. 2.

The lid 26 connects to the housing 20 by means of a wire bail 30 extending between an inner surface of both the lid and the bottom wall 22. More particularly, and with reference to FIGS. 2 and 6, the bail 30 has a lower portion with an inwardly directed free end 32 captured on the interior bottom wall 22 via a pair of loops 34*a* and *b* fixed on the bottom wall 22. The first loop 34*a* may be formed by distorting a portion of the bottom wall 22 upwardly forming this first loop 34*a*. The second loop 34*b* may be formed by welding a piece of material to the bottom wall. As thus far described, the wire bail 30 could still be removed from the two loops by pushing the free end 32 in the direction of the arrow C (FIG. 6). In order to thwart this, a tab 36 is bent upwardly from the housing bottom wall 22 to serve as an abutment beyond which the lower free end 32 cannot advance. Thus the bail 30 is fixed to the bottom wall 22. This has significance when considering the modules to be described shortly.

The bail 30 also has an upper portion (FIG. 2) which includes an inwardly bent free end 38 that laps over a lock plate 42. The lock plate 42 includes a central opening 44 that cooperates with a lock 46 positioned on the lid 26 (FIG. 3). The lock 46 has two radially extending tangs 48. When the tangs 48 are at right angles to the elongate rectangular opening 44 and underlie the lock plate 42, the lid 26 is locked to the housing 20. When the tangs 48 register with the opening 44, the lid 26 can be removed.

Note that the lock plate 42 is supported above the bottom wall 22 by a pair of bails 30. These bails are located as shown in the drawing figures at diametrically opposed corners of the lock plate 42.

In a preferred form of the invention, the housing 20 has four sidewalls 24. Thus, four modules 40 can be interposed between a top edge of each sidewall 24 and an associated lip 28 of the lid 26. As shown in FIGS. 1 through 3 and 7, the module 40 is preferably formed from transparent material such as Lexan along the area above the housing sidewall 24 and below the lid 26. Thus, the interior contents of each module 40 will be displayed to the potential vendee. The transparent portions of the module 40 define a container having four upwardly extending walls and a lower integrally formed combination hopper and gate 50.

Figure 2:
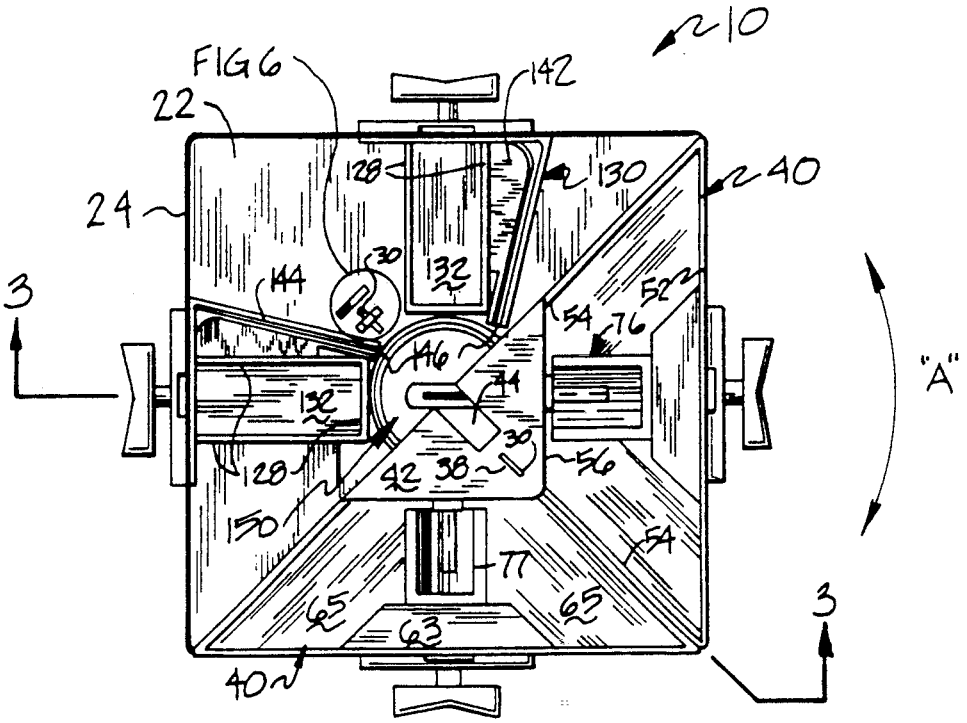
FIG. 2 is a top plan view of that which is shown in FIG. 1 with the lid and two modules removed to assist in clarity.

Each of the four modules 40 includes a front wall 52 and a pair of rearwardly extending sidewalls 54 which terminate in a rearwall 56. As shown in FIG. 2 for example a top plan view of the module 40 is such that the wall 56 terminates right along an edge of the lock plate 42, and the walls 54 substantially parallel a diameter, extending between opposite corners of the square lock plate 42, and also extending outwardly to corners of the housing. As thus described, four modules 40 can be positioned within one housing 20 providing a vendee with four potential choices of merchandise.

The bottom edge of all walls 52, 54 and 56 nest around the combined hopper-gate mechanism 50. Since the module and hopper gate assemblies 40, 50 are made of plastic, the hopper can be attached to the transparent walls via cement. At the general area where the top edge of the hopper meets the lower most portion of the transparent module 40, a plan or section view of either (e.g. FIG. 2) would suggest a substantially isosceles trapezoid configuration.

However, as the hopper declinates downwardly towards the gate, an inverted apex is formed with sidewalls of the hopper having the following general contour: a pair of substantially triangular vertical hopper sidewalls 64 below the sidewalls 54 of the module 40; a vertical rear hopper wall 66 which parallels the rear module wall 56; and a vertical front hopper wall 62*a*, *b* which includes a recess 63 to accommodate the coin mechanism 110 to be discussed.

The hopper has an inwardly declinating floor 65 to allow the hopper to come to its lowest point adjacent the gate. The floor 65 would have been substantially triangular but for its abutment with the rear hopper wall 66 and the effect of the recess 63: thus the floor is truncated at those areas of abutment. Note also the floor 65 is formed from two sections interrupted by the gate.

The rear wall 66 of the hopper supports an agitation means 70 extending into the hopper area. The agitation means 70, in the form of a paddle, has a central axle 72 from which radiates a first and second pair of turning arms 74. One pair of turning arms 74 is disposed at an extremity of the axle 72 and most closely towards the midpoint of the hopper assembly, while the second pair of arms is slightly closer to the rearwall 66. A stop member 73 is provided as the axle 72 extends towards the rear hopper wall 66. As shown, the rear hopper wall includes a boss 67 which is physically proximate to the stop 73. The paddle 70 negates the tendency of pellet shaped articles to form an "arch" or "bridge" which results in a void or pocket immediately above the gate to be discussed. When a void is present, a vendee will receive a smaller quantity of the goods than was intended by the vendor. A drive mechanism for rotating the agitation means is to be discussed shortly. As thus far detailed, the hopper would allow contents therewithin to pour through a lower most opening 76 but for the gate structure.

Figure 7:
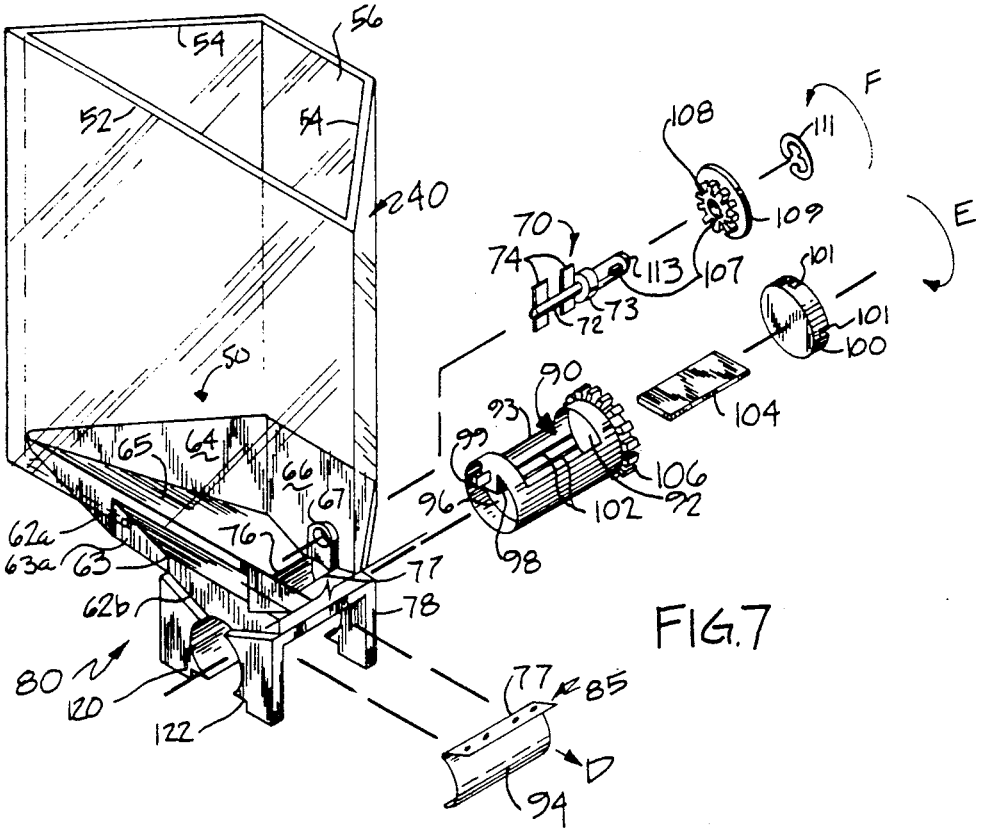
FIG. 7 is an exploded parts perspective of the module, with a portion removed for clarity.

In essence, a gate depends from the opening 76 of the hopper supported by a cradle 80 fastened to the floor 65 of the hopper. The cradle 80 includes a pair of ribs 78 which are fastened to and depend from the outer wall of floor 65 of the hopper. For most applications, plastic, curved, support guides 82 (FIG. 3) can be symmetrically disposed on both sides of a dispensing trough 90 as shown in FIGS. 3 and 7. In essence, the trough 90 is formed as an elongate cylindrical drum having a cutaway opening 92 on a portion of one side wall which communicates with the opening 76 at the lower most portion of the hopper. Because the opening 92 has substantially the same dimension as the opening 76, all material will fall neatly therethrough.

Figure 7A:
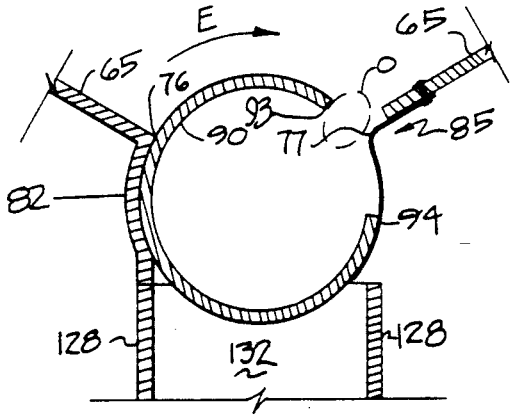
FIG. 7A shows a FIG. 7 detail in a first position.
Figure 7B:
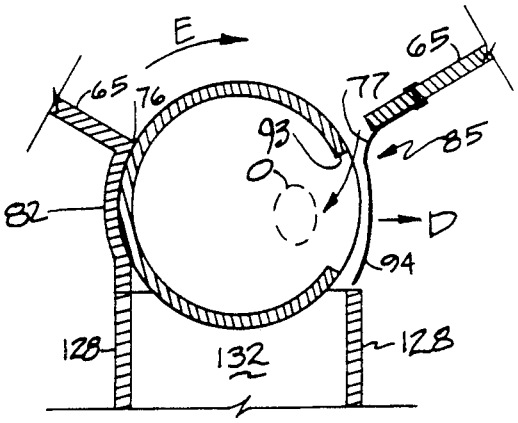
FIG. 7B shows the FIG. 7A detail in a second position.

Some pelletized articles to be vended, however, such as "jaw breakers" can become wedged between a leading edge 93 of the opening 92 and an edge 77 of the hopper opening 76. Please see FIGS. 7A and 7B. When this occurs, a child may be unable to gain sufficient mechanical advantage by turning a coin handle (to be described). The wedging action defeats the expectation of the consumer and jams the machine.

In order to offset this possibility, a portion of the floor 65 closest to the area where the trough's leading edge 93 closes upon the hopper edge 77 is formed from an arcuate strip 85 of spring material to replace a relatively non-deformable guide 82. Stated somewhat differently, one of the ribs 78 and guides 82 is replaced with a similarly shaped guide 85 but from a material such as polycarbonate having 0.03 thickness. This spring guide 85, when riveted to the floor 65 near edge 77 and extending downwardly in place of the guide 82 becomes a deformable wall 94 which only yields (in the direction of arrow D) in the presence of candy 0 e.g. wedged by edges 77 and 93. Otherwise spring guide 85 affords a great resistance to being displaced. Please see FIGS. 7A and B.

Thus, the cradle 80 supports the trough 90 in depending relationship from the hopper, and rotation of the trough 90 clockwise, arrow E, forms a gate which opens and closes. More specifically, the trough 90 is substantially drum-shaped and has a front wall 96 which supports a reinforcing member 98 that carries a hook 99 that connects to a coin operating mechanism to be discussed.

The drum shaped trough 90 also includes a removable rearwall 100 which, when removed, exposes a plurality of grooves 102 on an inner surface of the drum. Cutouts 101, on an annular flange of rearwall 100, allow removal of the rearwall 100 from the trough 90. The grooves 102 are spaced on opposite sides of the drum's cylindrical inner surface and support a removable shelf 104. Any one of several shelves 104 can be used. Each has a different size to change the interior volume of the trough 90 as measured between the shelf 104 and the opening 92. Thus, fewer expensive foods, such as Macadamia nuts can be placed within the trough 90 by controlling by the height of the shelf 104 with respect to the depth of the trough 90.

As mentioned, a hook 99 coacts with a coin mechanism and is adapted to rotate the opening 92 from a receiving position in the hopper to a lower most position, discharging the contents vended through a chute. While the trough 90 is being rotated in direction E, a gear 106 fastened to a rear portion of the trough 90 rotates as well. This gear meshes with an agitator gear 108 that causes the agitator 70 to rotate in the direction of arrow F via key drive 107. Note gear 108 includes a retainer plate 109. This plate is fixed in position by stop 73 coacting against boss 67 and locked by circlip 111 fixed in seat 113. Plate 109 laps over gear 106. This keeps the trough 90 in place.

The means by which the hook 99 and trough 90 are rotated can now be explored, with particular reference to FIGS. 1 and 3. As shown, a coin mechanism 110 includes a handle 112 and a slot 114 for receiving a coin therein. When an appropriately dimensioned coin is placed within the slot 114, rotation of the handle 112 in the direction of the arrow G will cause the trough to rotate in the direction of the arrow E as discussed above. The trough 90 is connected to the handle 112 by means of a fork 116 that straddles the hook 99 of the trough 90. As mentioned above, a recess 63 is provided on a frontwall 62 of the hopper which allows the frontwall to have an upper portion 62*a* and a lower 62*b* disposed in substantially vertical planes, with lower frontwall portion 62*b*, inset to provide clearance for the coin operating mechanism 110. The coin operating mechanism 110 operates on a familiar principle by which the appropriately sized coin operates a trip which allows a disc carrying the coin to be rotated, and is not shown here so as to not obscure the novel aspects of the instant invention. Rather, other details are described with greater particularity.

Assume that the machine is one which requires a quarter to operate. As shown, when the quarter is placed within the slot 114, the handle 112 is capable of being enabled. Should an inappropriate coin be inserted instead, i.e., one having a smaller diameter, it would rest within the slot 114 only temporarily. As shown, smaller diameter coins such as a nickel would try to balance at a lower most portion of the slot, but be unsuccessful. Because a shoulder 117 is provided to one side of the center line of a 25 cent piece, the nickel will instead roll down a passageway 115 and exit the machine via a slit 118 and be retrieved by the potential vendee. Note that the passageway 115 declinates downwardly and therefore the inappropriately sized coin rolls by virtue of gravity back to the vendee. Note that the slit 118 is unobtrusive in that it is disposed on a side edge of the coin operating mechanism 110. Note also that the clearance provided by the recess 63 includes inwardly directed walls 63*a* (FIG. 7) to provide a transition between the upper and lower portions 62*a*, 62*b* respectively for clearance with the operating mechanism associated with the coin fork 116 and hook 99.

The module 40 is provided with one further accommodation to be easily removable from the vending machine 10. Feet 120 (FIG. 7) are provided to nest upon a combined chute and coin chase 130 to be described. More specifically, in FIG. 7 the feet 120 include a ledge 122 which abuts upon a top edge 128 of the chute portion. Note that on the side of the relatively inflexible arcuate guide 82, a middle foot 124 is provided. These feet 120, 124 add rigidity to the guides 82. In the case of the arcuate strip 85 formed from flexible material, note that FIG. 7 reveals no central foot, since it would be counterproductive to the flexibility. Thus, not only does the module 40 stand on the top edge 128 of the chute 130, the five feet 120 also allow the module 40 to be freestanding on a table, for example, so that the module can be filled with candy or other commodities and stably supported without external assistance.

As shown in FIGS. 2 and 3, the chute 130 includes a pair of spaced sidewalls 134 depending from the top edges 128, and a ramp 132 which declinates downwardly towards an opening which is occluded by a door 136. Thus, contents of the module 40 pass down the ramp 132 and out the door 136 according to the arrow H. Note that the door moves between an open and closed position as indicated by the double ended arrow I and is normally spring biased to remain closed. The bottom ramp 132 supports a downwardly depending support leg 138 which fastens to the bottom wall 22 of the housing 20. The sidewalls 134 also include a groove 140 which receives the vertical walls 24 of the housing therewithin.

As mentioned earlier, when the coin reaches a lower most part of the supporting disc, it is discharged for collection in a coinbox 150. The coinbox to be discussed receives the coin from a coin chase 144 integrally connected with the chute assembly 130. Essentially, the coin chase 144 is supported with the chute 130 by means of a webbing 142 (FIG. 2) extending between the chase 144 and one sidewall 134 of the chute. The webbing 142 (FIG. 2) declinates downwardly, paralleling the chase 144. It is preferred that both the coin chase 144 and the candy chute be integrally formed from an injection molding process, so that both are rigid and interconnected. In essence, the coin chase includes a pair of walls spaced from each other by substantially the thickness of the coin so that the coin rolls down the chase on its edge. The chase also includes a bottom wall to contact the coin's edge. All of the coin chases deposit the coins in a central area of the housing 20. As mentioned earlier, the housing 20 has a bottom wall 22 provided with an opening. This opening also passes through the upper and lower race plates 16*a*, 16*b* and allows access to an interior of the pedestal P.

Figure 4:
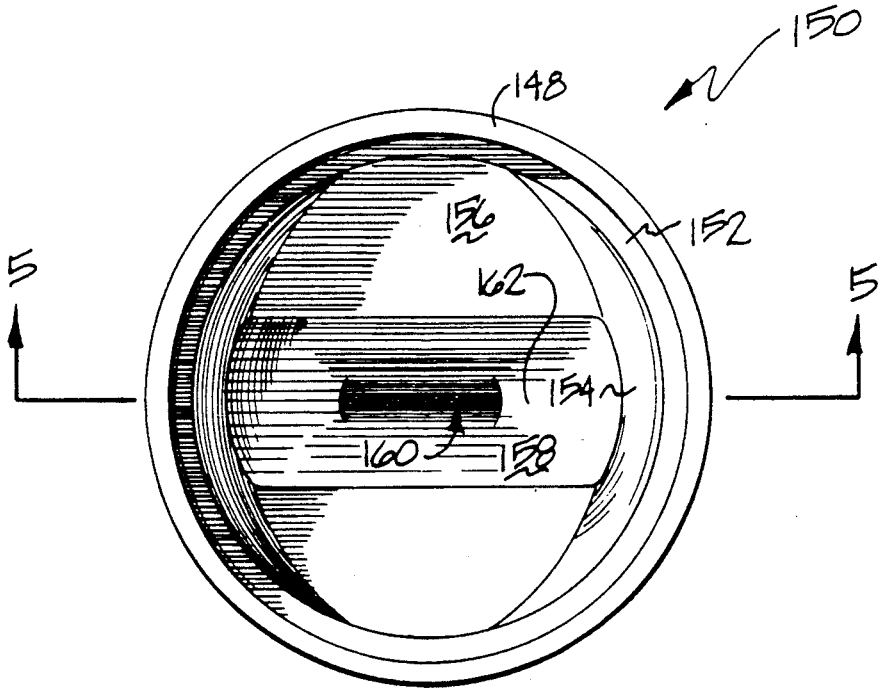
FIG. 4 is a top plan view of the canister shown in FIGS. 2 and 3.
Figure 5:
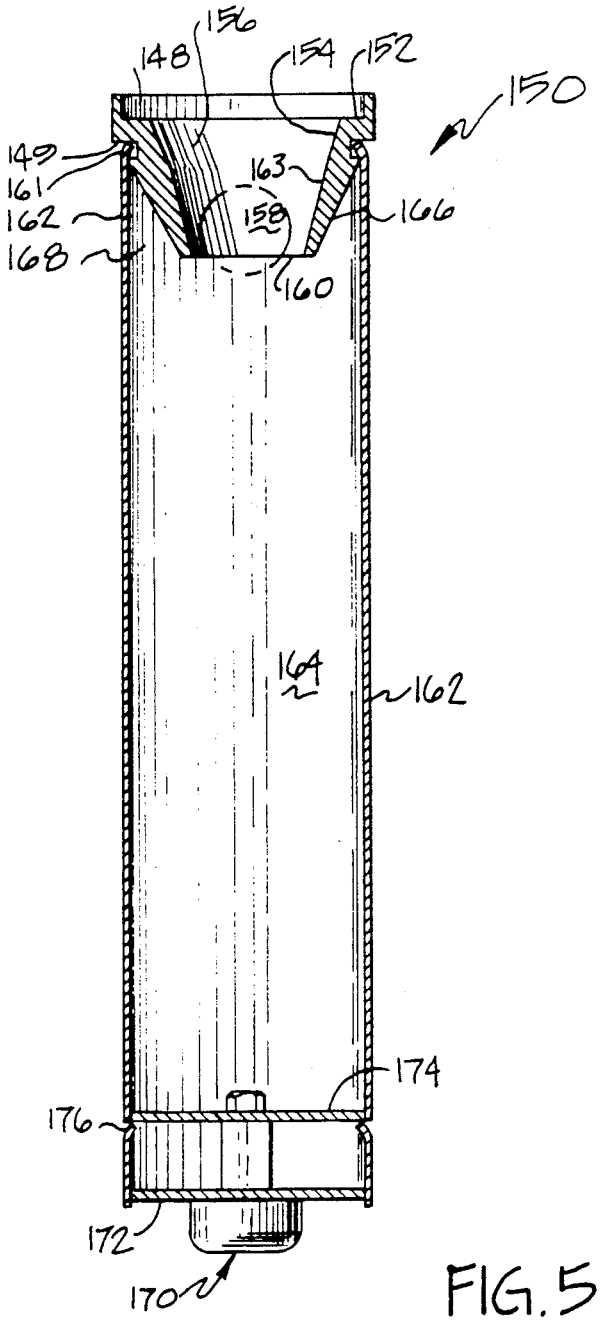
FIG. 5 is a sectional view taken along lines 5—5 of FIG. 4.

The top most portion of the pedestal P supports a coin safe 150. As shown in FIGS. 5 and 4, the safe 150 includes an elongate cylindrical section 162 having one end provided with a coin inlet 160 and another end provided with a locking door 172.

More specifically, the coin inlet 160 is formed by a molded cap having a peripheral flange 148 circumscribing the cylindrical section 162 and resting thereupon by means of a ledge 149. The coin inlet cap is fixed to the cylinder 162 by means of distressed portions 161 indenting within the plastic forming the coin inlet material. The peripheral flange 148 communicates with a shelf 152 extending radially inwardly. The flange 148 in turn communicates with a pair of diametrically opposed arcuate and conically tapering segments 154 extending from the shelf and down towards the coin inlet. In addition, a pair of diametrically opposed ramps 156 interrupt the segments 154 and extend from the shelf 152 and down towards the coin inlet. There is an area of transition from where the ramps 156 and segments 154 stop and the coin inlet 160 begins. This is generally configured as a converging nozzle having planar tapering walls 158 facing each other, and interconnected by arcuate segments 163. The arcuate segments 163 extend downwardly from the upper segments 154, while the planar portions of the converging nozzle 158 communicate with the ramps 156 which are also substantially planar. In use and operation, a coin will exit the chase 144 from is open end 146 and land on the cap. The cap is configured so that the coins will ultimately pass through the slot 160 and into the interior 164 of the coin safe 150. The coin inlet construction is such that a space 168 extends between the interior wall of the cylinder 162 and the coin inlet 160. An interior cap wall 166, facing the interior 164 of the coin safe, makes it extremely difficult for coins to be shaken back out of the inlet 140. Because the inlet 160 extends within the interior 164 of the coin safe 150, tendency is for coins to congregate closer to the areas 168, 166 than to pass back through the narrow slit defining the coin inlet 160. Thus, unauthorized access to the coins is made quite difficult when attempting to shake the coins out.

On an opposed end of the coin safe 150, a locked door 172 is provided. Specifically, the door 172 is operated by a key lock 170 having, within the interior of the coin safe 150, a pair of radially extending wings 174. The wings 174 are supported of rotated by a key (not shown) which activate the wings 174 and allow rotation of the wings to engage inwardly directed distressed portions 176 for locking engagement.

Having thus described the invention, it should be apparent that numerous structural and adaptations may be resorted to without departing from the scope and fair meaning of the instant invention, as set forth here and above and defined here and below by the claims.

We claim:

1. A vending machine comprising, in combination:

an open top housing, a plurality of modules configured to removeably reside within said housing, each said module having circumscribing sidewalls, said module further having a hopper and gate mechanism fastened to lower portions of said circumscribing sidewalls and defining a lower enclosure, said module thereby defining an open top container which allows a module to be removed from said housing without disturbing contents contained within said module because said gate mechanism is removed along with said module, a plurality of coin operated mechanisms coupled to said housing such that one said coin mechanism is provided for operative association with each said module, means between said gate of each said module and said associated coin operated mechanism to open said gate for dispensing some of the contents of said associated module upon actuation of said coin operated mechanism, a lid which is placed on top of and occludes said modules, and includes lock means extending to said housing to prevent unauthorized removal of said lid, said module sidewalls extend above said hopper and gate mechanism and said sidewalls are formed from transparent material so that a potential vendee can examine the contents within each said module, and said transparent material has a height which elevates said lid above said housing, said lock means includes a bail extending between said lid and said housing along a central vertical core area of said machine and said bail is surrounded by said plurality of modules whereby said bail is protected from access by unauthorized personnel, said housing includes a bottom wall and upwardly extending sidewalls and said plurality of hoppers of said modules collectively circumscribe an inner periphery of said sidewalls of said housing by nesting within said housing, said modules further including feet means below said gate which allows said module to be freestanding on a support surface when removed from said machine to facilitate upright orientation of said module apart from said machine, said housing includes plural discharge chutes within said housing with one said discharge chute in underlying registry with one each of said gates of said plural modules when said modules are deployed in said machine, and said feet means are also formed to perch upon said discharge chute.

2. The machine of claim 1 wherein said housing is supported in an elevated position by means of an upwardly extending pedestal having a lower portion connected to a base and an upper portion connected to said housing.

3. The machine of claim 2 wherein said pedestal connects to said housing by means of a turntable located below said housing on a bottom wall thereof to allow said housing to rotate relative to said pedestal.

4. The machine of claim 3 wherein said lid has a peripherally depending lip which overlies a top portion of said sidewalls of said modules to contain said modules under said lid.

5. The machine of claim 4 wherein said lock means includes a lock mechanism on a central portion of said lid to releasably couple with said bail.

6. The machine of claim 5 including a shock absorbing liner on a lower surface of said lid which abuts against top edges of said modules.

7. The machine of claim 6 including a hole at a lower portion of said hopper which communicates with said gate, said gate including a drum shaped trough axially insertable within a cradle formed in said hopper, so that said trough is removed with said module from the machine.

8. The machine of claim 7 wherein said drum shaped trough includes a means to reduce an interior volume of said drum shaped trough to alter its payload volume.

9. The machine of claim 8 including a coin safe communicating with each of said coin operated mechanisms to receive coins therefrom, said coin safe located in said pedestal and depending from an edge of a hole formed on said bottom wall of said housing, said coin safe having an inlet dimensioned to receive a coin therethrough and a tapering upper portion funnels coins to said inlet and precludes coins from being shaken out, and a lock means on said coin inlet.

10. The machine of claim 9 including an agitation means coupled to said gate formed as a paddle and passing into said hopper area whereby said coin operated mechanism operates both said gate and said paddle.

11. The machine of claim 10 wherein said cradle includes one resilient wall supporting said drum shaped trough to yield in the presence of hard objects to be vended provided an anti-jamming effect.

* * * * *